US010406401B2

(12) United States Patent
Vard

(10) Patent No.: US 10,406,401 B2
(45) Date of Patent: Sep. 10, 2019

(54) AQUATIC EXERCISE AND FLOTATION APPARATUS

(71) Applicant: Amir Vard, Huntsville, AL (US)

(72) Inventor: Amir Vard, Huntsville, AL (US)

( * ) Notice: Subject to any disclaimer, the term of this patent is extended or adjusted under 35 U.S.C. 154(b) by 0 days.

(21) Appl. No.: 15/298,531

(22) Filed: Oct. 20, 2016

(65) Prior Publication Data

US 2017/0106244 A1 Apr. 20, 2017

Related U.S. Application Data

(60) Provisional application No. 62/243,915, filed on Oct. 20, 2015.

(51) Int. Cl.
*A63B 35/06* (2006.01)

(52) U.S. Cl.
CPC ..... *A63B 35/06* (2013.01); *A63B 2225/605* (2013.01)

(58) Field of Classification Search
None
See application file for complete search history.

(56) References Cited

U.S. PATENT DOCUMENTS 2,635,911 A * 4/1953 Szillage ..... A01B 1/16 294/50
3,052,897 A * 9/1962 Martin ..... A63B 35/06 416/70 R
3,411,166 A * 11/1968 Kimmel ..... B63B 27/146 182/196
3,889,308 A * 6/1975 Persson ..... A63B 35/06 403/347
3,970,032 A * 7/1976 Phillips ..... B63H 16/04 440/102
4,416,451 A * 11/1983 Solloway ..... A63B 21/0084 473/457
4,458,896 A * 7/1984 Solloway ..... A63B 21/0084 482/111
4,468,023 A * 8/1984 Solloway ..... A63B 21/0084 441/124
4,521,011 A * 6/1985 Solloway ..... A63B 21/0084 441/59
4,627,613 A * 12/1986 Solloway ..... A63B 21/0084 472/128
7,090,618 B2 * 8/2006 Stout ..... A63B 21/0084 482/55
7,303,452 B1 * 12/2007 Ertz, III ..... B63B 45/04 440/101
7,335,136 B2 * 2/2008 Brodbeck ..... A63B 69/12 434/254
7,727,123 B2 * 6/2010 Stout ..... A63B 21/0084 482/111
7,955,226 B2 * 6/2011 Dauben ..... A63B 31/00 441/129
9,359,055 B2 * 6/2016 Blumer ..... B63H 16/04
(Continued)

*Primary Examiner* — Stephen R Crow
(74) *Attorney, Agent, or Firm* — Bradley Arant Boult Cummings LLP

(57) ABSTRACT

The present disclosure provides an aquatic exercise and flotation apparatus comprising a handlebar for maneuvering the apparatus, a flotation cylinder positioned on the handlebar and encompassing the handlebar by way of a hollow center, a first fin positioned at the first longitudinal end of the handlebar, and a second fin positioned at the second longitudinal end of the handlebar.

12 Claims, 6 Drawing Sheets

(56) References Cited

U.S. PATENT DOCUMENTS

| | | | | |
|---|---|---|---|---|
| 2004/0166969 | A1* | 8/2004 | Schneider | A63B 59/40<br>473/527 |
| 2012/0164897 | A1* | 6/2012 | Udell | B63C 7/003<br>440/101 |
| 2013/0059493 | A1* | 3/2013 | Downing, Jr. | B63C 9/08<br>441/80 |
| 2015/0118924 | A1* | 4/2015 | Hess | B63H 16/04<br>440/101 |

* cited by examiner

AQUATIC EXERCISE AND FLOTATION APPARATUS

CROSS-REFERENCE TO RELATED APPLICATIONS

This application claims the benefit of, and priority to, U.S. Provisional Application No. 62/243,915 filed Oct. 20, 2015 titled "Aquatic Exercise and Flotation Apparatus."

FIELD OF THE INVENTION

This invention relates generally to a device useful for water activities, and more specifically relates to a device particularly useful for aquatic exercise and flotation.

BACKGROUND OF INVENTION

A myriad of aquatic exercise equipment currently exists, such as flotation devices, resistance belts, and webbed gloves. These devices allow users to perform various exercises in the water and build muscle strength through the water's natural resistance. In addition, many aquatic exercise tools are for therapeutic purposes, which allow those with physical weaknesses to ease pain and build strength in an environment that is more forgiving on bones, joints, and muscles. However, the vast majority of the aquatic exercise equipment currently in existence focus on one area and do not provide the capability to float, swim, and exercise simultaneously. Therefore, a need exists for an apparatus that combines floating, swimming, and exercising capabilities and allows use by people of all ages and levels of physical fitness.

SUMMARY OF THE INVENTION

In view of the foregoing shortcomings inherent in the conventional type of methods and systems now present in the prior art, the present invention provides an aquatic exercise and flotation apparatus that combines the capability to float, swim, and exercise simultaneously and that can be used by people of varying ages and fitness levels.

In one embodiment, the aquatic exercise and flotation apparatus comprises a handlebar for maneuvering the apparatus and further comprising a first longitudinal end and a second longitudinal end, a flotation cylinder positioned on the handlebar and encompassing the handlebar by way of a hollow center, a first fin positioned at the first longitudinal end of the handlebar, and a second fin positioned at the second longitudinal end of the handlebar.

In another embodiment, the aquatic exercise and flotation apparatus comprises a handlebar for maneuvering the apparatus and further comprising a first longitudinal end and a second longitudinal end, a flotation cylinder positioned on the handlebar and encompassing the handlebar by way of a hollow center, a first fin support attached to the first longitudinal end of the handlebar, a second fin support attached to the second longitudinal end of the handlebar, a first fin attached to the first fin support such that the first fin support is located between the first fin and the first longitudinal end of the handlebar, and a second fin attached to the second fin support such that the second fin support is located between the second fin and the second longitudinal end of the handlebar.

Other objects and advantages of the present invention will become obvious to the reader and it is intended that these objects and advantages are within the scope of the present invention.

To the accomplishment of the above and related objects, this invention may be embodied in the form illustrated in the accompanying drawings/pictures, recognizing however, that the drawings are illustrative only, and that changes may be made in the specific construction illustrated and described within the scope of the appended claims.

BRIEF DESCRIPTION OF DRAWINGS

It should be noted that identical features in different drawings are shown with the same reference numeral. Various other objects, features and attendant advantages of the present invention will become fully appreciated as the same becomes better understood when considered in conjunction with the accompanying drawings.

DETAILED DESCRIPTION

An aquatic exercise and flotation apparatus has been developed. The present invention combines swimming, exercising, strength building, and flotation into one apparatus, and is designed for use with people of all ages and physical fitness levels. The apparatus can be used in enclosed bodies of water such as swimming pools or lakes, or can be used in open bodies of water, such as oceans or rivers. Moreover, the present invention may be used for a variety of purposes, such as strength building, swimming practice, flotation, recreational activities, and physical therapy.

Figure 1:
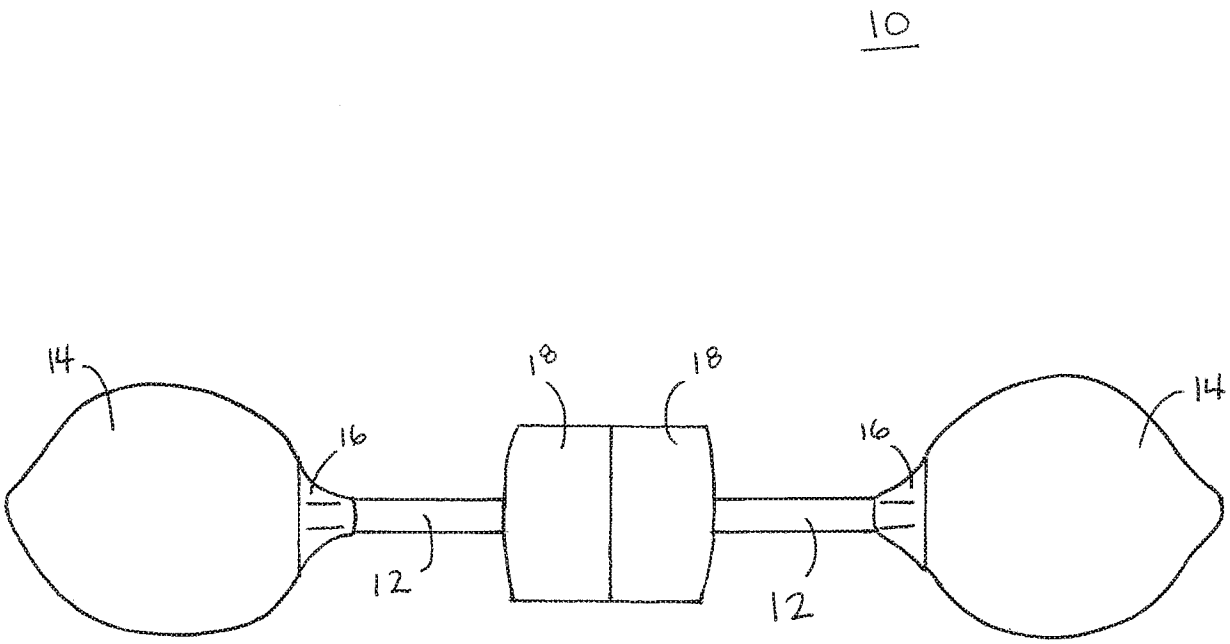
FIG. 1 shows a front view of one embodiment of the present invention.

One embodiment of the aquatic exercise and flotation apparatus 10 is depicted in FIG. 1. The apparatus 10 includes a handlebar 12 for a user to grip with his or her hands and maneuver the apparatus 10. The handlebar 12 may be one single rod extending throughout the length of the apparatus 10. Alternatively, the handlebar 12 may comprise two or more segments (not shown) that are fixed to one another in order to form one longer shaft or rod. The handlebar 12 may be made of polyvinyl chloride plastic ("PVC"), or other type of lightweight plastic, so that the handlebar 12 is sturdy but also lightweight and buoyant. Additionally, the handlebar 12 may be made of non-plastic substances such as wood, composite, or lightweight aluminum. Generally, the handlebar 12 may be tube-like in structure, maintaining a hollow interior to add to the handlebar's 12 buoyancy. For example, PVC piping may be used to construct the handlebar 12 to keep it both lightweight and hollow. Alternatively, if made of a lightweight material, the handlebar 12 may be solid or cylindrical in structure.

The handlebar 12 may include grips (not shown) placed at certain locations along the handlebar 12, to allow a swimmer to more easily grip and maneuver the apparatus 10 without slippage. Alternatively, the surface of the handlebar 12 may be covered with a rough material (not shown) to provide additional traction for the swimmer's hands. In some instances, the handlebar 12 may include straps (not shown) or handles (not shown) so that a user may grip and maneuver the apparatus 10 with his feet, thus allowing exercise of different muscle groups.

FIG. 1 also shows the flotation cylinders 18 positioned in the center of the apparatus 10, as further described below in reference to FIGS. 2 and 3. Also shown in FIG. 1 are two fins 14, positioned on either longitudinal end of the apparatus 10. The fins 14 may be attached to the handlebar 12 by fin supports 16, as further described below in reference to FIG. 4.

In use of the apparatus 10, a swimmer may grip the apparatus 10 with both hands on the handlebar 12—one hand on each side of the flotation cylinders 18. The swimmer may hold the apparatus 10 in front of his body with arms extended, and alternatively push and pull each hand in the opposite direction, outward from his body and inward toward his body, causing the apparatus 10 to sway back and forth. This motion, similar to the rotating motion used by a kayaker when paddling through the water, creates resistance in the water by the fins 14, therefore working the swimmer's pectoral and shoulder muscles. In another manner of use, the swimmer may not alternate his arms but instead move them both outward and inward at the same time. This motion similarly creates resistance in the water by the fins 14 and exercises the swimmer's muscles. There are countless techniques to utilize with the apparatus 10 depending on user preference and the target muscle area. The apparatus 10 can be used by a person standing in shallow water or swimming in deeper water, due to its flotation capabilities. Furthermore, the apparatus 10 may be used on the surface of the water, or it may be pushed under the water for added resistance.

In any event, a key feature of the apparatus 10 is that the handlebar 12 is not overly long. The apparatus 10 is designed for use with individual swimmers who are either swimming or standing in the water, and for use in physical therapy and exercise situations. As a result, the apparatus 10 does not need to be a great deal wider than the swimmer himself. Preferably, the handlebar 12 will be long enough that a swimmer can grip the apparatus 10 comfortably on either side of the flotation cylinders 18 and hold his arms out in front of his body. However, the handlebar 12 does not need to extend much farther than that, and in fact it is preferable that the fin supports 16 are located in a close proximity to the portion of the handlebar 12 that will be gripped by the user.

Figure 2:
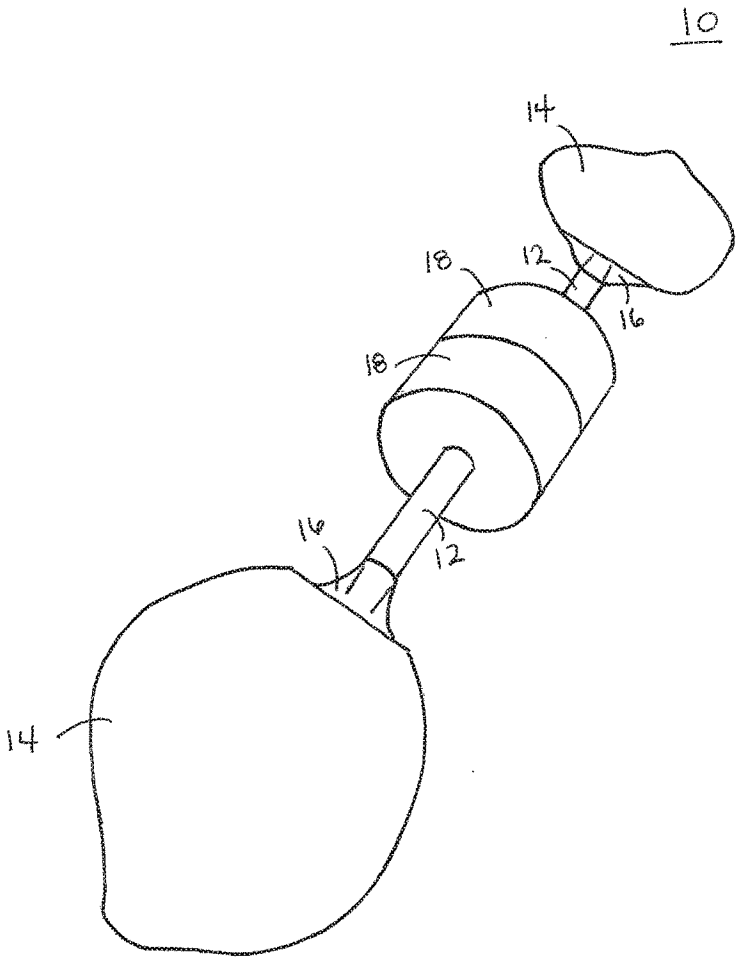
FIG. 2 shows a front perspective view of one embodiment of the present invention.
Figure 3:
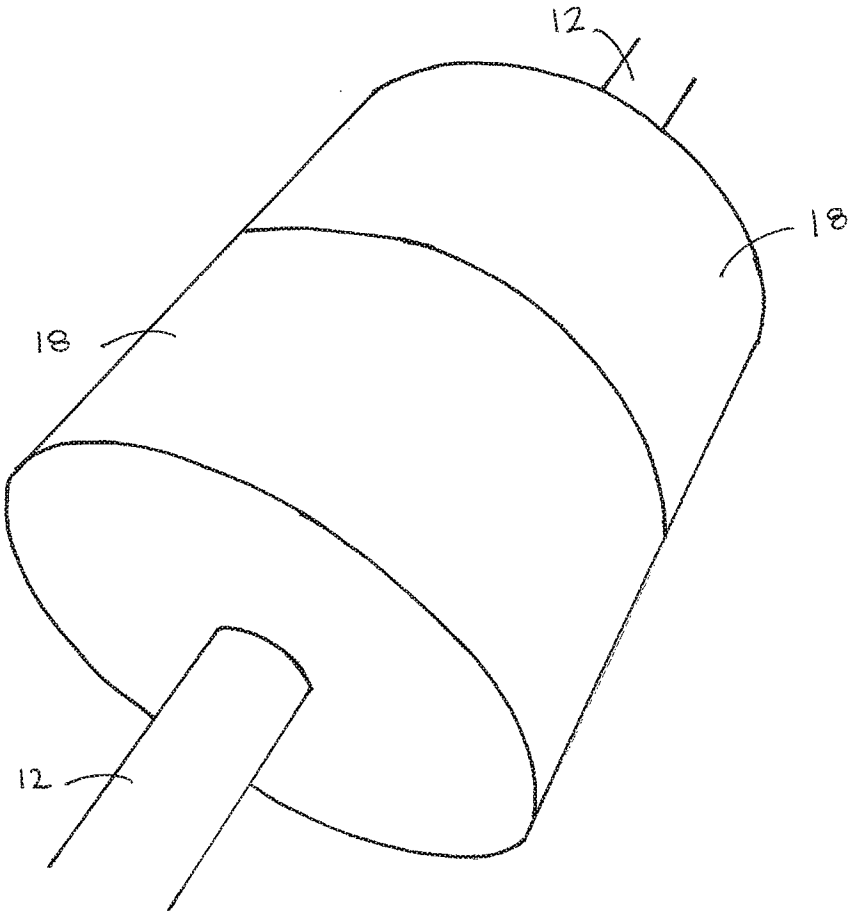
FIG. 3 shows a front perspective view of the flotation cylinders in accordance with one embodiment of the present invention.

FIGS. 2 and 3 show views of the apparatus 10 in which the flotation cylinders 18 can be seen clearly. The flotation cylinders 18 may be positioned in the center of the apparatus 10 so that the buoyancy properties are distributed along the apparatus 10 evenly, though the present invention contemplates that the flotation cylinders 18 may be located in different areas on the apparatus 10. Each of the flotation cylinders 18 may be cylindrical in overall shape, and may contain an opening in the concentric center so that the handlebar 12 may be routed through the flotation cylinder 18. Alternatively, however, the flotation cylinders 18 may any number of shapes, including squares, rectangles, tubes, sheets, and the like. Moreover, the flotation cylinders 18 may have squared-off or rounded edges.

Although the embodiment in FIGS. 1, 2, and 3 shows the use of two flotation cylinders 18, any number of flotation cylinders 18 may be used depending on user preference. For example, the apparatus 10 may include only one flotation cylinder 18 if the user is a child or small person who does not need the buoyancy properties of more than one flotation cylinder 18, or who is not strong enough to push and pull an apparatus 10 underwater if it includes more than one flotation cylinder 18. Similarly, the apparatus 10 may include three or more flotation cylinders 18 if the user is a larger person who needs more buoyancy to stay afloat, or who needs more assistance swimming. The flotation cylinders 18 may be attached to the handlebar 12 such that they are removable, and a swimmer may use as many or as few as desired.

In a preferred embodiment, the flotation cylinders 18 are made of an ethylene-vinyl acetate ("EVA") or poly(ethylene-vinyl acetate) ("PEVA") foam substance, commonly used in aquatic equipment, such as kickboards or pool noodles. EVA foam allows the flotation cylinders 18 to be lightweight, sturdy, water-resistant, and highly buoyant. This type of foam may be easily constructed in a variety of shapes and sizes, allowing the flotation cylinders 18 to be any shape or size, as described above. The flotation cylinders 18 may also be made of alternate materials, such as other types of foam or plastic. For example, the flotation cylinders 18 may be air-filled structures having either a rigid outer shell (not shown), or a soft, inflatable shell (not shown). The present invention contemplates that many types of buoyant material and structures may be used to provide flotation capabilities for the apparatus 10.

Figure 4:
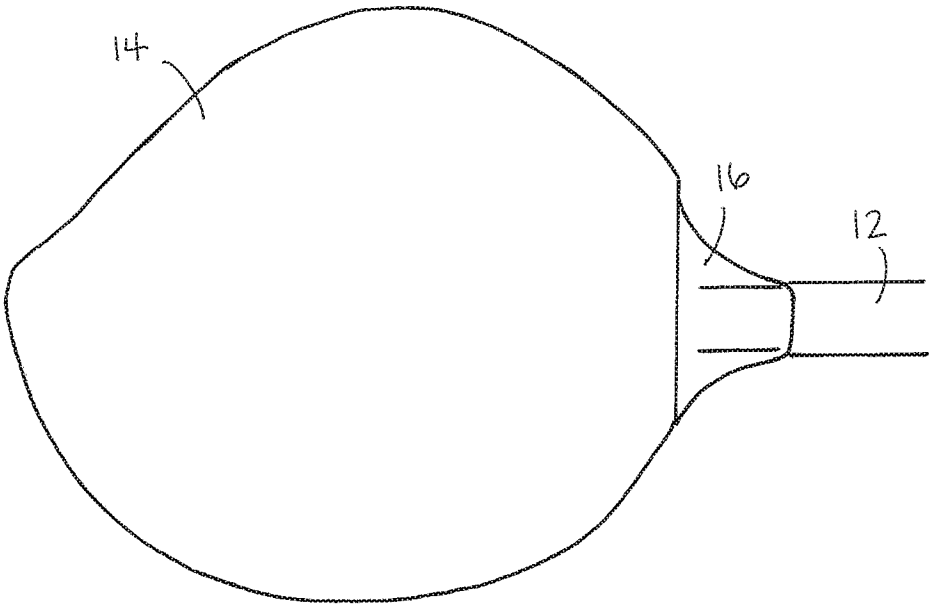
FIG. 4 shows a front view of a fin in accordance with one embodiment of the present invention.

FIG. 4 shows a fin 14 on one end of the apparatus 10. The fin 14 may be paddle- or blade-like in order to provide resistance in the water, being thin overall when viewed from the tip or longitudinal end, but having a broad, flat surface when rotated. Although the fin 14 is shown with a particular shape, the present invention contemplates any number of paddle-like shapes may be used for the fins 14, including those having cross-sections that are asymmetric, symmetric, curved, concave, winged, flat, dihedral, inclined, spooned, pointed, or twisted, to name a few examples.

FIGS. 1 and 2 show both fins 14 at either longitudinal end of the handlebar 12. The two fins 14 will complement one another and allow the user to maintain symmetry with the exercises and movements. In a preferred embodiment, the fins 14 may be mirror images of one another with regard to shape, thus allowing the same resistance for each side of the body. The present invention contemplates fins 14 which are not mirror images of each other, though symmetry of motion is preferred in order to most efficiently exercise muscle groups and avoid unbalanced strength. For the same reasons, the fins 14 may also be oriented at the same pitch angle in opposite directions, similar to blades in a ceiling fan, so that they provide a similar movement on each side. In this regard, the broad side of the fins 14 would appear twisted or skewed slightly in relation to each other. Alternatively, the fins 14 may both have a flat pitch angle, making the broad side of each of the fins 14 appear as though they are located in the same geometric plane.

FIG. 4 also shows the fin supports 16, which essentially connect the fins 14 to the handlebar 12. The fin support 16 may be a separate piece fixed to the handlebar 12 on one side, and connected to the fin 14 on the opposite side. Alternatively, the fin support 16 may not be a separate piece but instead may be an extension of the fin 14 itself, making the fin 14 capable of direct attachment to the handlebar 12. In the embodiment shown, the fin support 16 includes a recess on one end which is larger in diameter than the handlebar 12. As a result, the handlebar 12 can slide into the recess of the fin support 16, allowing the two elements to fit together. In alternative embodiments, the converse method may be used, that is, the hollow interior of the tube-like handlebar 12 may be larger in diameter than an extension (not shown) on the fin support 16, allowing the fin support 16 to slide into the handlebar 12. The present invention contemplates that other methods may be used to attach the handlebar 12 to the fins 14 or fin supports 16, such as a dowel pin or rod (not shown) being inserted into the centers of the two pieces.

Figure 5:
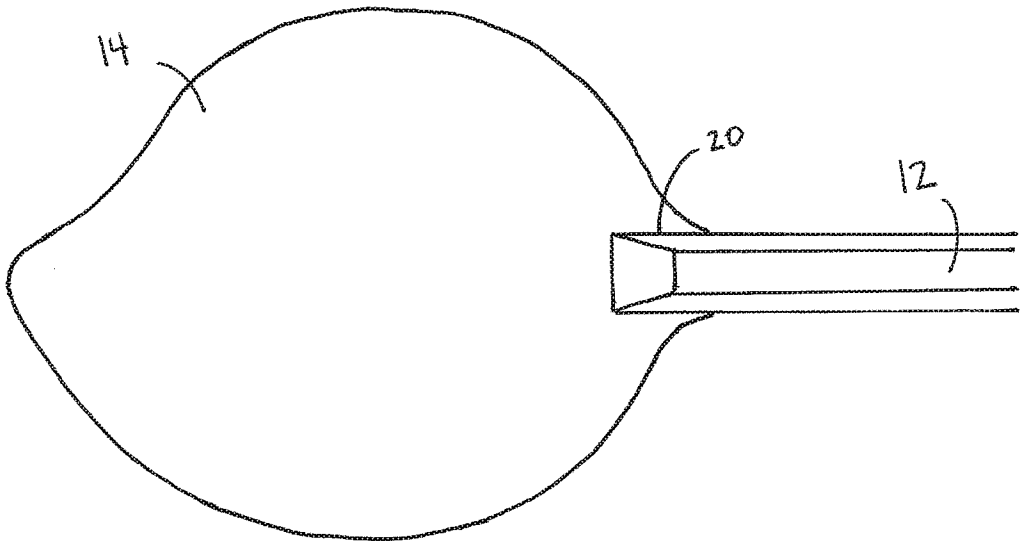
FIG. 5 shows a front view of a fin in accordance with another embodiment of the present invention.
Figure 6:
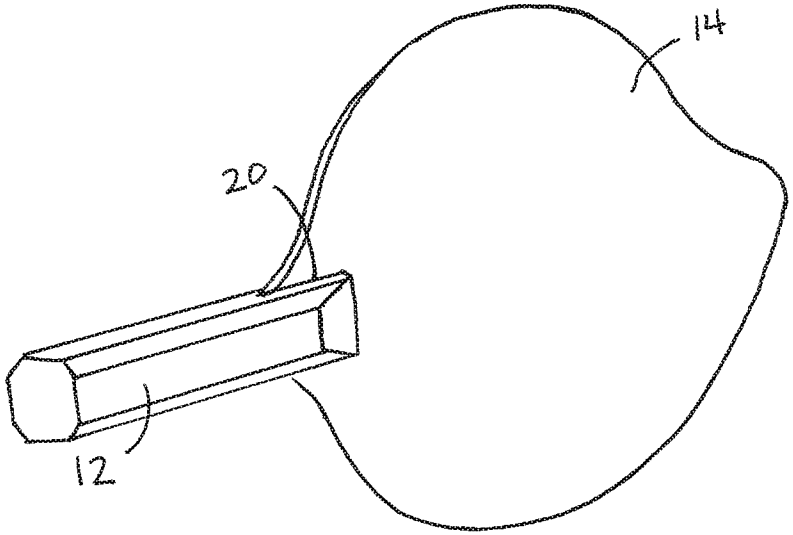
FIG. 6 shows a rear perspective view of a fin and handlebar cross-section in accordance with another embodiment of the present invention.

For example, FIGS. 5 and 6 show an alternative method of attaching the handlebar 12 to the fin 14. In this embodiment, no fin support 16 is used. Instead, the handlebar 12 itself contains a recessed slot 20 at each of its terminating ends. This recessed slot 20 is slightly wider than the width of the fin 14 such that the fin 14 may slide into the recessed slot 20. The present invention contemplates that a number of fastening methods may be used to more permanently attach the fin 14 to the handlebar 12 once it is inserted into the recessed slot 20, such as an adhesive material between the contacting surfaces of the fin 14 and recessed slot 20. Alternatively, a rod (not shown), pin (not shown), or screw (not shown) may be inserted through the handlebar 12 and fin 14 at the location of the recessed slot 20, so that the attachment is more secure.

FIGS. 5 and 6 also show an alternative shape of the handlebar 12. In this embodiment, the handlebar 12 cross-section is an octagonal shape, whereas the handlebar 12 shown in FIGS. 1 through 4 has a circular cross-section. The present invention contemplates that any number of geometric shapes could be used as a cross-section of the handlebar 12, including but not limited to a square (not shown) or hexagon (not shown) shape.

In a preferred embodiment, the fins 14 and fin supports 16 may be made of PVC or other plastic material, allowing for the same durable, lightweight, water resistant characteristics as those of the handlebar 12 discussed above. Similarly, however, the fins 14 and fin supports 16 may be made of other materials such as composite, lightweight aluminum, or wood, in keeping with the purpose of the present invention. Buoyancy is a key feature of the present invention, allowing swimmers to use the apparatus 10 even if they generally have trouble keeping themselves afloat, and even without the use of separate floats or supports.

While the invention has been described with respect to a limited number of embodiments, those skilled in the art, having benefit of this disclosure, will appreciate that other embodiments can be devised which do not depart from the scope of the invention as disclosed here.

What is claimed is:

1. An aquatic exercise and flotation apparatus comprising:

a. a handlebar for maneuvering the apparatus and further comprising:
   i. a first longitudinal end; and
   ii. a second longitudinal end;

b. a flotation cylinder positioned at a center point on the handlebar and encompassing the handlebar by way of a hollow center, wherein the flotation cylinder is attached to the handlebar at the center point and is immovable during use;

c. a first fin positioned at the first longitudinal end of the handlebar; and d. a second fin positioned at the second longitudinal end of the handlebar, wherein the first longitudinal end and the second longitudinal end each further comprise a recessed slot for receiving the fin and each fin is permanently attached to the handlebar.

2. The aquatic exercise and flotation apparatus of claim 1 wherein the handlebar further comprises a single rod extending throughout the length of the apparatus.

3. The aquatic exercise and flotation apparatus of claim 1 further comprising at least one hand grip located on the handlebar.

4. The aquatic exercise and flotation apparatus of claim 1 further comprising at least one handle located on the handlebar.

5. An aquatic exercise and flotation apparatus comprising:

a. a handlebar for maneuvering the apparatus and further comprising:
   i. a first longitudinal end; and
   ii. a second longitudinal end;

b. at least two flotation cylinders positioned at a center point on the handlebar and encompassing the handlebar by way of a hollow center, wherein the at least two flotation cylinders are attached to the handlebar at the center point and are immovable during use;

c. a first fin positioned at the first longitudinal end of the handlebar; and d. a second fin positioned at the second longitudinal end of the handlebar, wherein the first longitudinal end and the second longitudinal end each further comprise a recessed slot for receiving the fin and each fin is permanently attached to the handlebar.

6. The aquatic exercise and flotation apparatus of claim 5 wherein the handlebar further comprises a single rod extending throughout the length of the apparatus.

7. The aquatic exercise and flotation apparatus of claim 5 further comprising at least one hand grip located on the handlebar.

8. The aquatic exercise and flotation apparatus of claim 5 further comprising at least one handle located on the handlebar.

9. The aquatic exercise and flotation apparatus of claim 1, wherein the handlebar is composed of polyvinyl chloride (PVC) piping.

10. The aquatic exercise and flotation apparatus of claim 5, wherein the handlebar is composed of polyvinyl chloride (PVC) piping.

11. The aquatic exercise and flotation apparatus of claim 1, wherein the flotation cylinder is composed of ethylene-vinyl acetate (EVA) or polyethylene vinyl acetate (PEVA).

12. The aquatic exercise and flotation apparatus of claim 5, wherein the flotation cylinder is composed of ethylene-vinyl acetate (EVA) or polyethylene vinyl acetate (PEVA).

* * * * *